US011821398B2

(12) United States Patent
Rehwald et al.

(10) Patent No.: US 11,821,398 B2
(45) Date of Patent: Nov. 21, 2023

(54) COMPONENT FOR AN INJECTION SYSTEM, IN PARTICULAR FUEL DISTRIBUTOR RAIL, INJECTION SYSTEM AND METHOD FOR PRODUCING SUCH A COMPONENT

(71) Applicant: BOSCH SANAYI VE TICARET ANONIM SIRKETI, Bursa (TR)

(72) Inventors: Andreas Rehwald, Bietigheim-Bissingen (DE); Cengiz Otuk, Nilüfer/Bursa (TR); Goekhan Guengoer, Hemmingen (DE); Husnu Ozpedal, Nilüfer/Bursa (TR); Marc Spinner, Sindelfingen (DE)

(73) Assignee: BOSCH SANAYI VE TICARET ANONIM SIRKETI, Bursa (TR)

( * ) Notice: Subject to any disclaimer, the term of this patent is extended or adjusted under 35 U.S.C. 154(b) by 0 days.

(21) Appl. No.: 17/641,236

(22) PCT Filed: Sep. 29, 2020

(86) PCT No.: PCT/EP2020/077170
§ 371 (c)(1),
(2) Date: Mar. 8, 2022

(87) PCT Pub. No.: WO2021/063911
PCT Pub. Date: Apr. 8, 2021

(65) Prior Publication Data

US 2022/0325685 A1 Oct. 13, 2022

(30) Foreign Application Priority Data

Oct. 2, 2019 (TR) ..... 2019/14989

(51) Int. Cl.
*F02M 55/02* (2006.01)
*F02M 61/16* (2006.01)

(52) U.S. Cl.
CPC ..... *F02M 55/025* (2013.01); *F02M 61/168* (2013.01); *F02M 2200/8053* (2013.01)

(58) Field of Classification Search
CPC ..... F02M 55/025; F02M 61/168; F02M 2200/8053
(Continued)

(56) References Cited

U.S. PATENT DOCUMENTS 10,138,854 B2 * 11/2018 Schultz ..... F02M 63/0225
11,274,642 B1 * 3/2022 Stewart ..... F02M 61/14
(Continued)

FOREIGN PATENT DOCUMENTS

DE 202015106569 U1 1/2016
GB 2224774 A 5/1990
JP 2018158372 A 10/2018

OTHER PUBLICATIONS

International Search Report for PCT/EP2020/077170, dated Nov. 25, 2020.

*Primary Examiner* — Hai H Huynh
(74) *Attorney, Agent, or Firm* — NORTON ROSE FULBRIGHT US LLP; Gerard Messina

(57) ABSTRACT

A component for an injection system, in particular a fuel injection rail for a fuel injection system. The component includes a main body that is processed by a single-stage or multi-stage forging, at least one fastening element being provided on the main body. The fastening element is formed at least partly by a residual flash. An injection system having such a component, and a method for producing such a component, are also described.

14 Claims, 5 Drawing Sheets

(58) Field of Classification Search
USPC ..... 123/456
See application file for complete search history.

(56) References Cited

U.S. PATENT DOCUMENTS

| | | | | |
|---|---|---|---|---|
| 2008/0178457 | A1* | 7/2008 | Nagasaka | F02M 55/025 123/456 |
| 2012/0138020 | A1* | 6/2012 | Kweon | F02M 61/14 123/469 |
| 2014/0305411 | A1* | 10/2014 | Ikoma | F02M 61/14 123/470 |
| 2017/0159627 | A1* | 6/2017 | Schultz | F02M 63/0225 |

* cited by examiner

COMPONENT FOR AN INJECTION SYSTEM, IN PARTICULAR FUEL DISTRIBUTOR RAIL, INJECTION SYSTEM AND METHOD FOR PRODUCING SUCH A COMPONENT

FIELD

The present invention relates to a component, in particular a fuel distributor rail, for a fuel injection system, to a method for producing a main body for such a component, and to an injection system. Specifically, the present invention relates to the field of fuel injection systems that are preferably used for mixture-compressing, externally ignited internal combustion engines, the fuel distributor rail being situated for example in an engine compartment of a motor vehicle and being used for the direct injection of fuel into combustion chambers of the internal combustion engine.

BACKGROUND INFORMATION

The Abstract and the Figures of Japan Patent Application No. JP 2018-158372 A show producing a main body for a distributor rail by forging. Here, the material is eccentrically forged, so that on the forged main body a plurality of connecting elements that are bored after forging, and also two fastening elements that are also bored after forging, are formed by the forging.

In a main body for a distributor rail that is produced according to the method of the Abstract and the Figures of JP 2018-158372 A, the fastening elements formed by the forging on the main body and subsequently bored have a high strength, so that the overall distributor rail can be reliably mounted and fastened using suitable attachment parts, for example to a cylinder head in an engine compartment.

However, the method of the Abstract and the Figures of JP 2018-158372 A has the disadvantage that the quantity of material to be processed by the forging is increased by an additional quantity of material for the fastening elements.

Particularly if the main body is to be formed from high-grade steel, this conventional realization of the fastening elements is then expensive.

SUMMARY

A component according to the present invention, and the injection system according to the present invention, may have the advantage that they enable an improved realization and functioning. In particular, a fastening possibility can be realized with optimized outlay. Corresponding advantages, and improved production, can be realized by the method according to the present invention.

The measures disclosed herein enable advantageous developments and embodiments of the component, the injection system, and the method.

The injection system in accordance with the present invention can be designed in particular as a fuel injection system used to inject a fuel or a mixture with at least one fuel. In addition, an injection system may be used not only for liquid fluids, but, if appropriate, may also enable the blowing in of gaseous fluids, in particular combustible gases.

Advantageously, in accordance with an example embodiment of the present invention, the fastening element can be formed at least partly by a residual flash. Such a residual flash results from a particular realization and combination of a forging and a subsequent partial removal of a flash that arises during the forging. Because the flash is only partially removed, at at least one location there remains a remnant that is then used to form the fastening element. Here it is possible that the fastening element is provided partly by the forging and is formed only partly by such a residual flash. Preferably, such a fastening element is however formed at least substantially by the remnant of the flash remaining there.

If the injection system is designed for example as a fuel injection system for motor vehicles, then, as a rule, it is necessary to fasten the injection system in the engine compartment, in particular on a cylinder head, where high loads occur. Therefore, as a rule, very strong fastening elements are provided on the injection system via which the fastening to, for example, the cylinder head takes place. For terminological distinction, such very strong fastening elements are here also referred to as mounting points. Differing from the proposed fastening elements, the mounting points in a fuel distributor rail therefore have to withstand high loads, so that they have to be realized for example by forging. In contrast, the fastening elements of the present invention are suitable for lower loads, so that they do not have to be formed by forging.

This results in a substantial difference with regard to the planning of the material quantities. The material for producing a component via the forging process can be cut to length for example from round stock. The material quantity then has a certain tolerance. The material cut to length is placed into a press that can be made up of a lower forging die and an upper forging die. The forging dies determine a contour for the forging process that defines the forged shape of the main body. Even at the lower end of the tolerances, it must be possible to fill the contour 100% during the forging. Because the contour for the main body varies locally, and for example can result in eccentricities, or a local requirement of more material, as a rule there results a locally varying quantity of the material that is displaced between the forging dies into a gap that receives the displaced material. In this way, the forging contour can be achieved in one or more forging steps in a reliable process. The reliable achieving of the forging contour necessarily results in a flash. A significant influencing variable on the size in each case of the flash is the material quantity, varying within tolerances, due to the cutting to length. Another significant influencing variable is the size of local material quantity fluctuations at the main body, caused for example by eccentricities.

Specifically given the use of high-quality materials, in particular high-grade steels, the minimization of the material consumption is a significant advantage. A significant aspect of the solution of the present invention is therefore to produce mounting points only for high loads, such as fastening to a cylinder head, by forging. For low loads, in contrast, fastening elements are realized in the proposed manner of the present invention. Here, the flash that is already formed anyway as a result of the process is advantageously used to realize one or more fastening elements. Suitable attachment parts, such as a plug, a cable, or a cable duct, can then be fastened to such fastening elements.

In one example embodiment, a through-opening provided on the fastening element is realized as a stamping. This development has the advantage that the through-opening can be stamped out using an existing tool, which can take place together with the additional removed flash. In one example embodiment, an average thickness of the residual flash is larger or smaller than an average thickness of a flash formed during the forging. In one example embodiment, a strength of the fastening element is provided such that a fastening of at least one attachment part, in particular a plug and/or a cable and/or a cable duct, to the main body is enabled. These developments may enable adaptation to the specific case of application. Specifically, here a local reduction of the thickness of the flash in the area of the remaining residual flash can be realized. In one example embodiment, on the main body at least one region is provided having a material requirement that is locally increased during the forging, and the fastening element is situated outside this at least one region on the main body. In this manner, relatively large fastening elements can also be reliably realized in the proposed manner. For example, the location for the remaining residual flash can then be selected at a certain distance from eccentricities or the like of the main body at which there is a local requirement of more material.

BRIEF DESCRIPTION OF THE DRAWINGS

Preferred exemplary embodiments of the present invention are explained in more detail in the following description with reference to the figures, in which corresponding elements are provided with matching reference characters.

DETAILED DESCRIPTION OF EXAMPLE EMBODIMENTS

On the basis of the Figures, possible embodiments and possible methods for producing a component 1 for an injection system are described. Specifically, such a component 1 can be designed as fuel distributor rail 1 and can be used for a fuel injection system in which a fluid is distributed to, preferably, a plurality of fuel injection valves. Here, component 1 is preferably designed such that it has a very high load capacity relative to a pressure of the fluid that is stored inside component 1 and is for example distributed to fuel injection valves. Component 1 is realized as forged component 1, so that high loads with regard to the pressure of the fluid are possible. Therefore, here a component 1 is shown whose main body 2 is forged.

Figure 1:
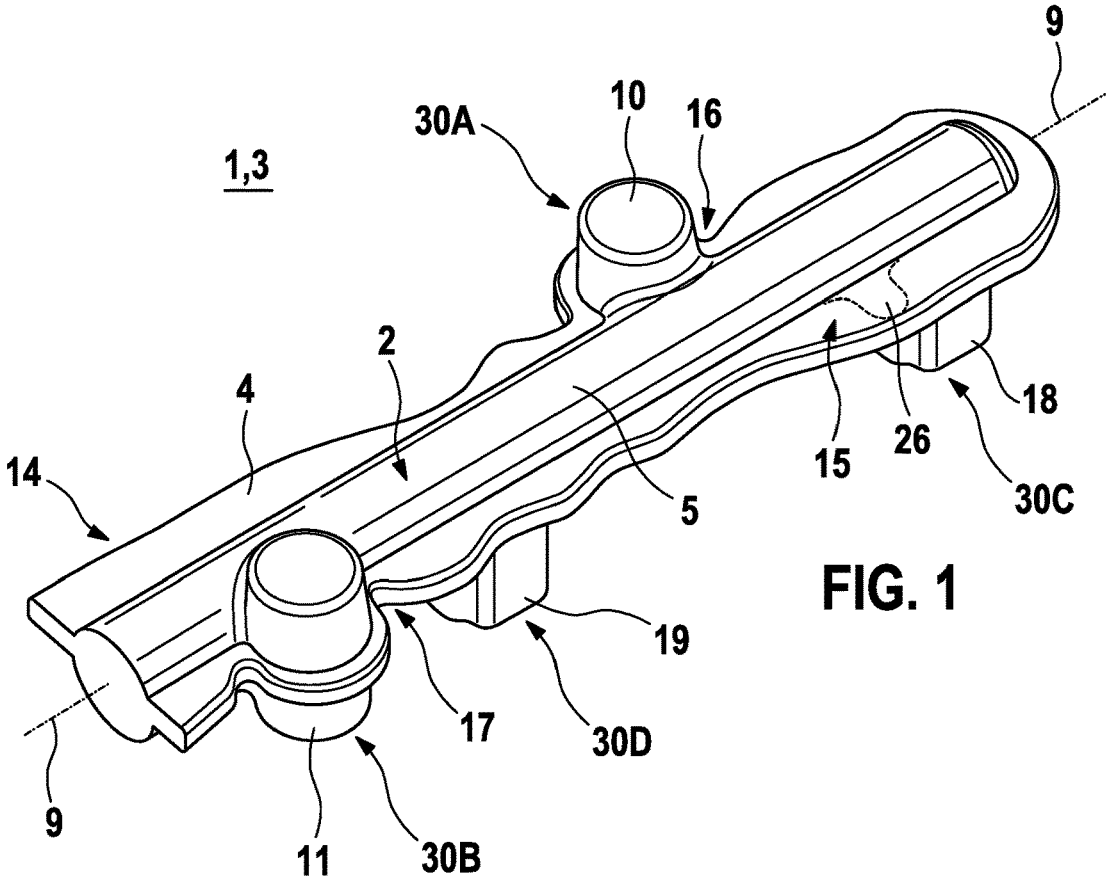
FIG. 1 shows material having a flash after a forging during the production of a component for an injection system, designed as a fuel injection system, in a schematic representation corresponding to a first exemplary embodiment of the present invention.

FIG. 1 shows a material 3 from which component 1 is produced, in a schematic representation corresponding to a first exemplary embodiment. Here, main body 2 is forged. In addition, during the forging there results not only main body 2, but also a flash 2 of the material 3 on main body 2. Thus, taken strictly, FIG. 1 does not yet show the finished component 1, but rather the material 3 that is processed by the forging and shaped to form main body 2 and flash 4.

Figure 2:
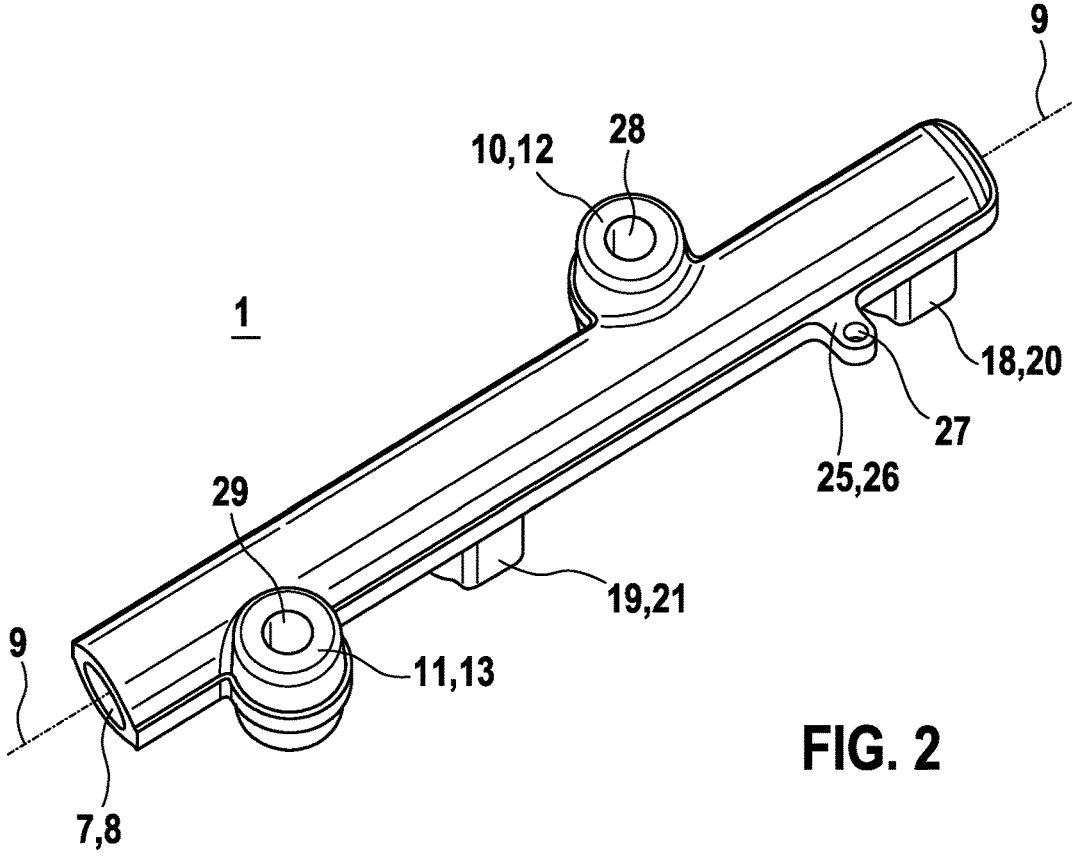
FIG. 2 shows the component produced after a further processing, in particular a stamping, from the material shown in FIG. 1, in a schematic representation corresponding to the first exemplary embodiment of the present invention.

For the forging, the desired shape of main body 2 can be specified in a complex manner. In this exemplary embodiment, main body 2 has a tubular part 5 that is also provided with a longitudinal bore 8 along a longitudinal axis 9 in order to form an internal compartment 7 (FIG. 2). In addition, main body 2 has eccentricities 10, 11 from which very strong fastening elements (mounting points) 12, 13 (FIG. 2) are formed. During the forging, here there results a locally increased material requirement, for example viewed along longitudinal axis 9.

Due to a locally increased material requirement, caused for example by eccentricities 10, 11, during the forging there results a significant contribution to the production of locally differing dimensions of flash 4. Specifically, here, in a region 15, there reliably results a larger dimensioning of flash 4 than for example in a region 16 or region 17 in the immediate vicinity of eccentricities 10, 11.

In this exemplary embodiment, on main body 2 further eccentricities 18, 19 are formed from which for example cups 20, 21 can be formed for the connection of the fuel injection valves. Generally, such eccentricities are to be viewed as largely determined in their number, their material requirement, and their situation. In this regard, in this way there results regions 14, 15 on flash 4 in which flash 4 is comparatively pronounced. As an example, region 15 is chosen in order to illustrate how, in the proposed manner, a fastening element 25 (FIG. 2) can be formed by a residual flash 26, which, in FIG. 1, is still a part of the overall flash 4.

FIG. 2 shows component 1, produced from material 3 shown in FIG. 1 after further processing, in particular stamping, in a schematic representation corresponding to the first exemplary embodiment. Here, flash 4, which is no longer required, is separated by stamping, but residual flash 26 is left standing on main body 2. In addition, a through-opening 27 is formed on residual flash 26. This can take place for example after the stamping in a further processing step, for example by boring. However, it is also possible for the stamping of through-opening 27 to take place in the same processing step as the removal of the unneeded flash 4.

In addition, bores 28, 29 are formed on eccentricities 10, 11, in order to realize mounting points 12, 13. Because mounting points 12, 13 are formed integrally on forged main body 2, they have a high load capacity. Mounting points 12, 13 are thus suitable in particular for fastening component 1, which can include main body 2 and further elements, to a cylinder head.

In comparison to mounting points 12, 13, fastening element 25 has only a low load capacity. Here, fastening element 25 can as a rule be dimensioned such that at least one attachment part of component 1, in particular a plug and/or a cable and/or a cable duct, can be fastened thereto. Depending on the application, here it is also possible to realize two or more such fastening elements 25 in suitable regions, for example also in region 14, on main body 2 through residual flashes corresponding to residual flash 26.

Here the fact is exploited that flash 4 will result anyway during the forging as a result of the process. Thus, in order to realize for example fastening element 25, no additional material is required with regard to material 3 that is to be shaped during the forging. Fastening element 25 then does have only a comparatively low load capacity, but can be realized without requiring additional material. The strength of fastening element 25 can here be determined to be within certain limits through the dimensioning of residual flash 26. Through eccentricities 10, 11, 18, 19, on main body 2 there result regions 30A through 30D having a locally increased material requirement during the forging. Region 15 is situated outside these regions 30A to 30D on main body 2, so that flash 4 there has adequately large dimensions to realize residual flash 26 with the desired dimensions.

Figure 3:
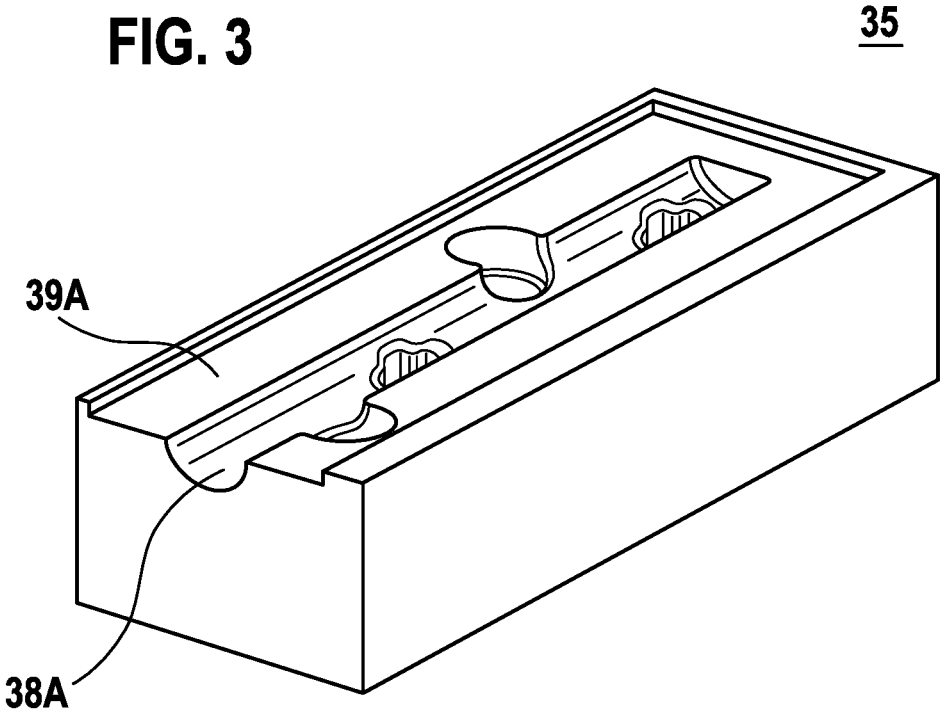
FIG. 3 shows a lower forging die for producing the forged material, shown in FIG. 1, for the component, corresponding to the first exemplary embodiment of the present invention.
Figure 4:
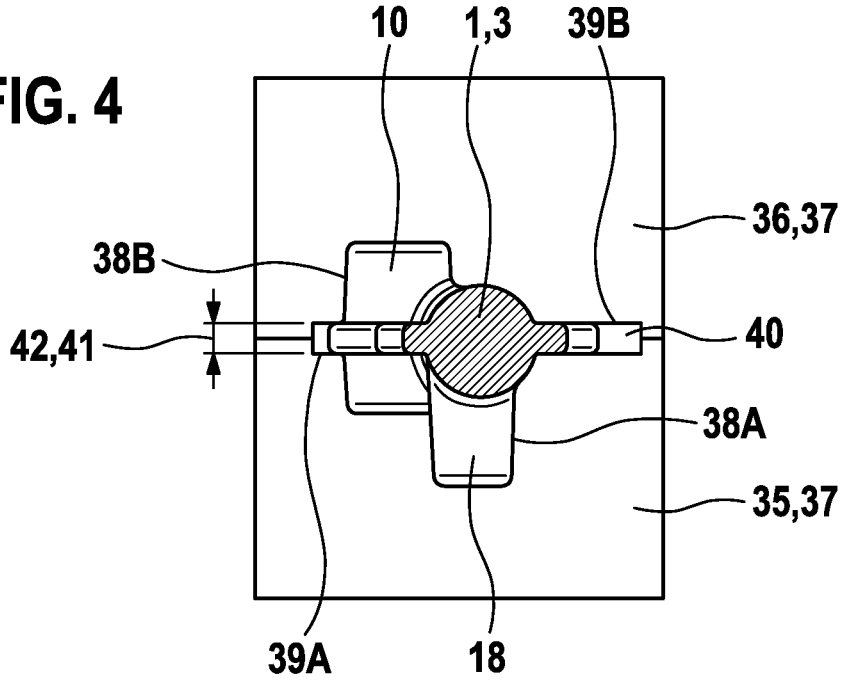
FIG. 4 shows the lower forging die shown in FIG. 3, together with an upper forging die, for the illustration of the forging of the material shown in FIG. 1, corresponding to the first exemplary embodiment of the present invention.

FIG. 3 shows a lower forging die 35 for producing forged material 3, shown in FIG. 1, for component 1 according to the first exemplary embodiment. FIG. 4 shows a lower forging die 35 shown in FIG. 3 together with an upper forging die 36 for the illustration of a forging tool 37 that is used to forge the material 3 shown in FIG. 1, corresponding to the first exemplary embodiment. In lower forging die 35, a half-mold 38A for main body 2 is substantially formed. The other half-mold 38B is formed in upper forging die 36. Here, forging tool 37 is shown in simplified fashion. In particular, it is also possible for a plurality of half-molds to be formed in each of forging dies 35, 36, material 3 being rearranged in forging tool 37 corresponding to the forging steps.

In dies 35, 36, lowered regions 39A are formed, causing a gap 40 to remain during the forging. Gap 40 enables the excess material to be displaced out during forging, thus forming flash 4. A gap height 41 here determines an (average) thickness 42 of the resulting flash 4.

Figure 5:
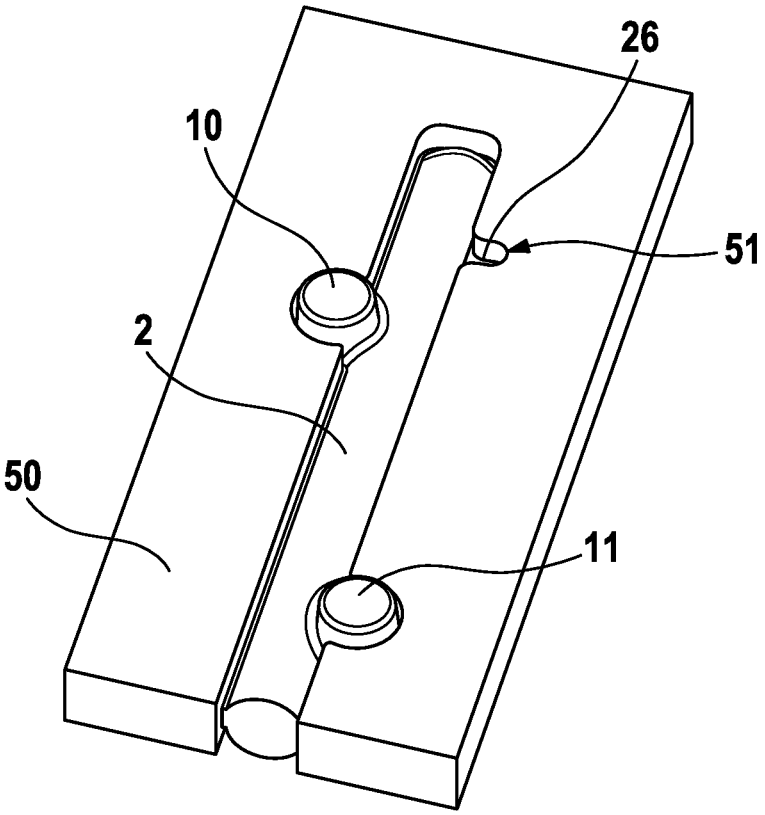
FIG. 5 shows a deflashing tool for the further processing of the material shown in FIG. 1, corresponding to the first exemplary embodiment of the present invention, in a detail schematic representation.

FIG. 5 shows a deflashing tool 50 for the further processing of material 3 shown in FIG. 1, corresponding to the first exemplary embodiment, in a detailed schematic representation. Here, the deflashing tool has a sectional line 51 adapted with regard to residual flash 26, by which, except for residual flash 26 that remains on main body 2, the unneeded extra flash 4 is removed.

Figure 6:
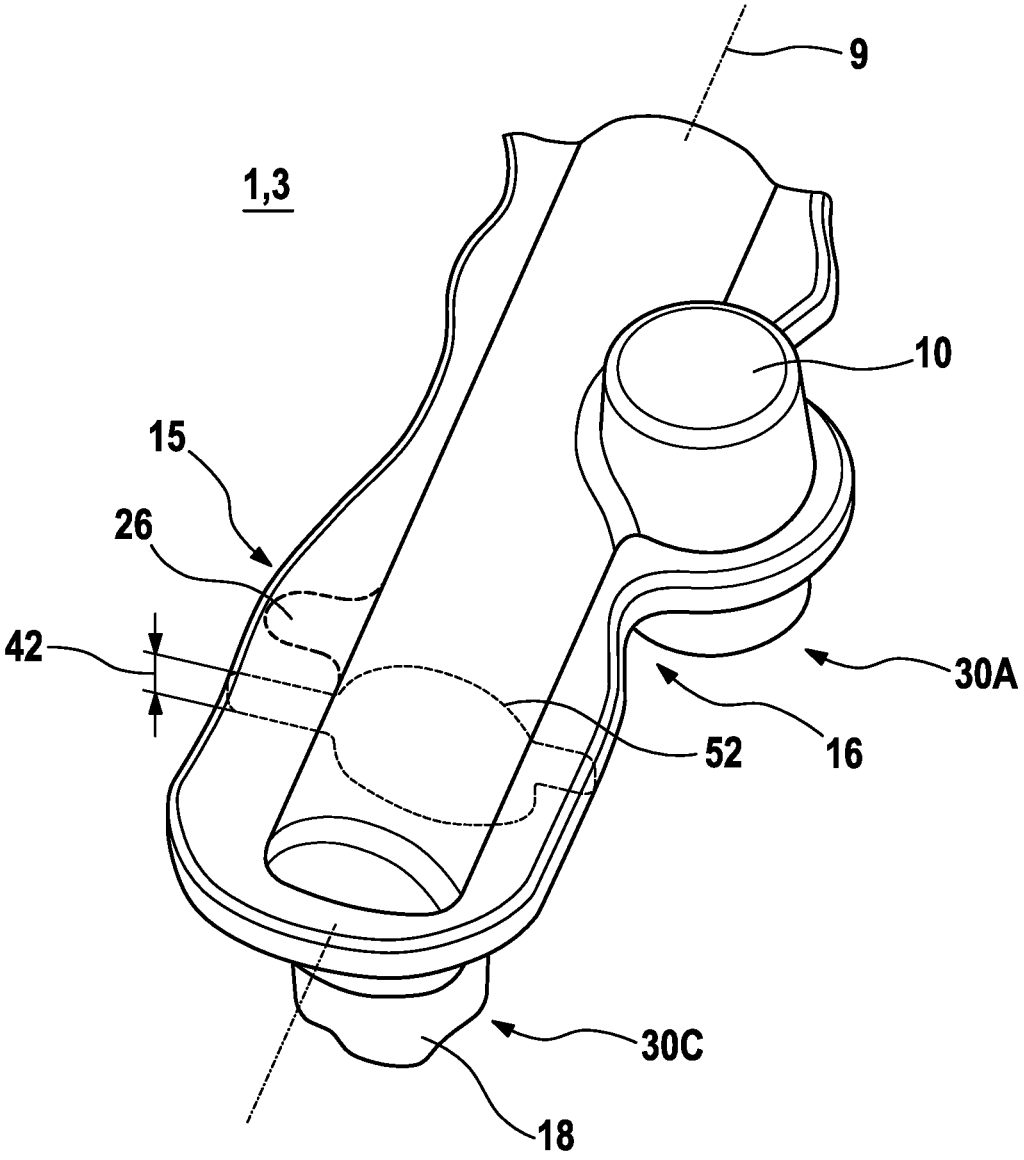
FIG. 6 shows a detail representation of the material shown in FIG. 1 for the explanation of a preferred local situation of fastening elements on a main body of the component for an optimized production.

FIG. 6 shows a detailed representation of material 3 shown in FIG. 1 for the explanation of a preferred local situation of at least one fastening element 25 on main body 2 of component 1 for an optimized production. The position of residual flash 26 is selected in a region 15 having a large flash dimension. A broken line 52 illustrates a profile 52 of material 2, including the formed flash 4, in a plane perpendicular to longitudinal axis 9. In this case, through the selection, residual flash 26 can be realized having thickness 42 of flash 4. This holds for the entire radial extension of residual flash 26.

Figure 7:
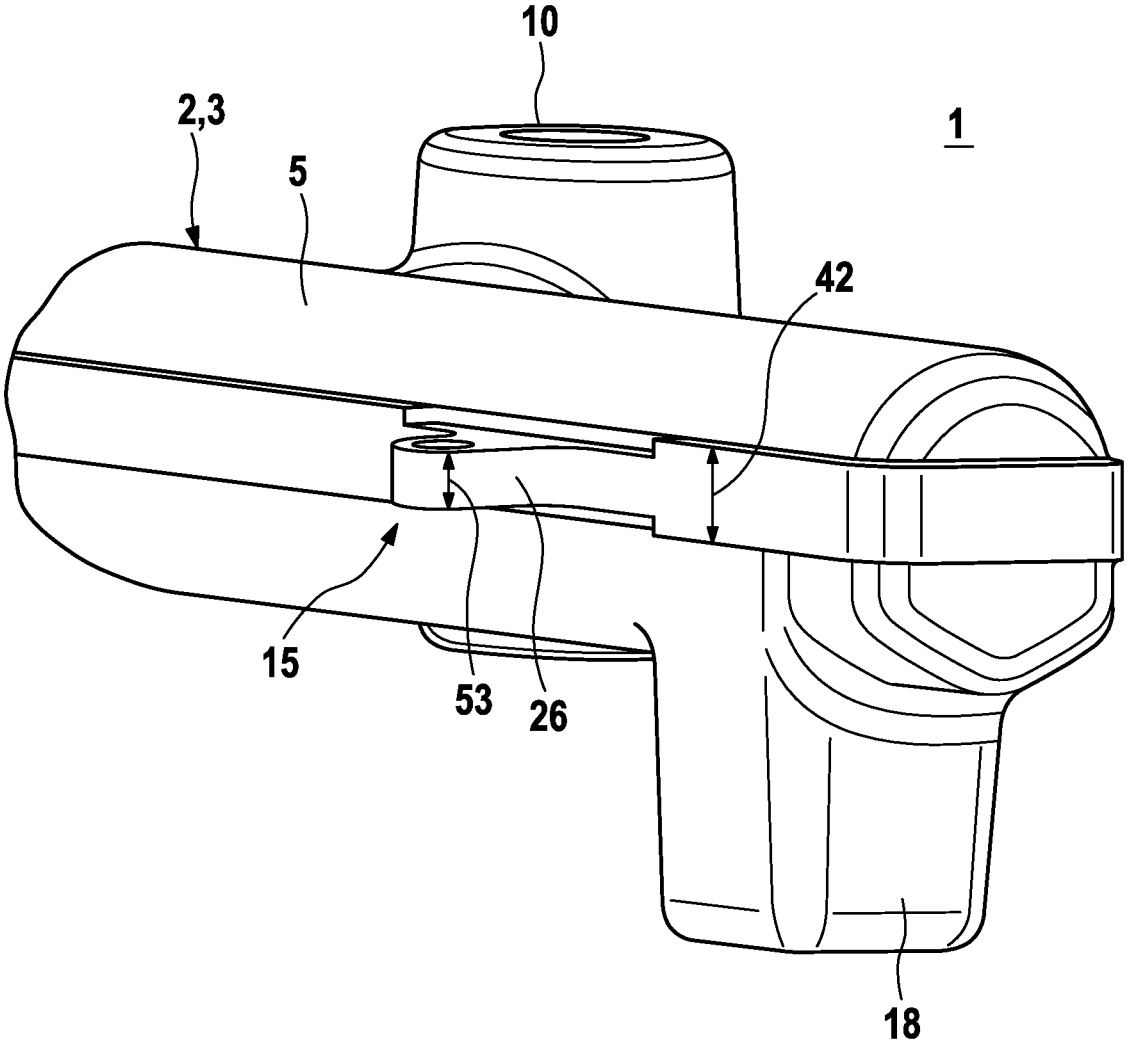
FIG. 7 shows a component shown in FIG. 2 in a detail representation corresponding to a second exemplary embodiment of the present invention.

FIG. 7 shows component 1 shown in FIG. 2 and a detailed representation corresponding to a second exemplary embodiment. Gap 40 illustrated in FIG. 4 can be formed as a function of the workpiece contour of the desired main body 2, including with a different gap height 41, along the workpiece geometry of main body 2. In this way, in particular the filling behavior of the half-molds 38A, 38B, determined by the cavity of forging tool 37, can in particular be controlled. This can have the result that in the region 15 in which residual flash 26 is placed, an average thickness of residual flash 26 is larger or smaller than an average thickness 42 of flash 4 formed during the forging.

Of course, main body 2 can be processed in further steps. In particular, milled-out portions can be made in eccentricities 18, 19 in order to form cups 20, 21.

The present invention is not limited to the described exemplary embodiments.

What is claimed is:

1. A component for an injection system, comprising:

a main body that is processed by a single-stage or multi-stage forging, at least one fastening element being provided on the main body, wherein the fastening element is formed by a partial removal of a residual flash.

2. The component as recited in claim 1, wherein the component is a fuel distributor rail for a fuel injection system.

3. The component as recited in claim 1, wherein the fastening element is formed at least substantially by the residual flash.

4. The component as recited in claim 1, wherein a through-opening provided on the fastening element is realized as a stamping.

5. The component as recited in claim 1, wherein an average thickness of the residual flash is larger or smaller than an average thickness of a flash formed during the forging.

6. The component as recited in claim 1, wherein a strength of the fastening element is provided such that a fastening of at least one attachment part to the main body is enabled.

7. The component as recited in claim 6, wherein the at least one attachment part includes a plug and/or a cable and/or a cable duct.

8. The component as recited in claim 1, wherein on the main body, at least one region is provided having a material requirement that is locally increased during the forging, and the fastening element is situated outside the at least one region on the main body.

9. An injection system, comprising:

at least one component having a main body that is processed by a single-stage or multi-stage forging, at least one fastening element being provided on the main body, wherein the fastening element is formed by a partial removal of a by a residual flash; and at least one attachment part fastened to the fastening element, the attachment part including a plug and/or a cable and/or a cable duct.

10. The injection system as recited in claim 9, wherein the injection system is a fuel injection system.

11. A method for producing a main body for a component of an injection system, comprising:

processing the main body with a single-stage or multi-stage forging, a flash resulting on the main body;

partly removing the flash;

forming a fastening element at least partially using a non-remove residual flash of the flash that was produced on the main body during the forging.

12. The method as recited in claim 11, wherein the component is a fuel distributor rail of a fuel injection system.

13. The method as recited in claim 11, wherein: (i) a through-opening is stamped in the fastening element, and/or (ii) the flash is removed by a stamping and the through-opening is formed in the fastening element by the stamping, in the same processing step.

14. The method as recited in claim 11, wherein the main body is forged in such a way that in a region of the residual flash that is not removed, the flash has a smaller or larger average thickness than in the rest of the region that is removed.

* * * * *